US006493534B2

(12) United States Patent
Sawanaka et al.

(10) Patent No.: US 6,493,534 B2
(45) Date of Patent: Dec. 10, 2002

(54) SHEET CONVEYING APPARATUS AND IMAGE FORMING APPARATUS

(75) Inventors: Kei Sawanaka, Sunto-gun (JP); Masao Ando, Mishima (JP); Takayasu Yuminamochi, Sunto-gun (JP); Tomio Noguchi, Susono (JP); Minoru Matsuguma, Susono (JP); Masaru Shimura, Numazu (JP); Kenji Kanari, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/771,980

(22) Filed: Jan. 30, 2001

(65) Prior Publication Data

US 2001/0033760 A1 Oct. 25, 2001

(30) Foreign Application Priority Data

Feb. 1, 2000 (JP) ..... 2000-028930
May 18, 2000 (JP) ..... 2000-146073

(51) Int. Cl.[7] ..... G03G 15/16
(52) U.S. Cl. ..... 399/316; 399/388
(58) Field of Search ..... 399/388, 316, 399/297, 313, 318, 307

(56) References Cited

U.S. PATENT DOCUMENTS 5,153,654 A 10/1992 Yuminamochi et al.
5,223,900 A 6/1993 Yuminamochi et al
5,225,881 A * 7/1993 Goto et al. .
5,240,242 A 8/1993 Ando et al. ..... 271/118
5,345,299 A * 9/1994 Hashizume et al. ..... 399/313
5,358,230 A 10/1994 Ikemori et al. ..... 271/114
5,386,983 A 2/1995 Ando ..... 271/118
5,424,818 A * 6/1995 Yoshimura et al. ..... 399/313
5,453,823 A * 9/1995 Hashizume et al. ..... 399/316
5,502,554 A * 3/1996 Hayashi et al.
5,552,873 A * 9/1996 Hirao et al.
6,032,949 A 3/2000 Ando ..... 271/225
6,055,395 A * 4/2000 Hiramoto ..... 399/316
6,055,409 A * 4/2000 Richards et al. ..... 399/388
6,125,244 A * 9/2000 Kamiya ..... 399/388

FOREIGN PATENT DOCUMENTS

JP 2000-66525 * 3/2000
JP 2000-75676 * 3/2000

* cited by examiner

*Primary Examiner*—Susan S. Y. Lee
(74) *Attorney, Agent, or Firm*—Fitzpatrick, Cella, Harper & Scinto

(57) ABSTRACT

A sheet conveying apparatus and an image forming apparatus include a transfer roller which transfers a developer developing an electrostatic latent image on a photosensitive drum to a sheet, a pair of registration rollers which nip the sheet into a conveying nip formed by a pair of rotary members and conveys the sheet to the transfer roller, and an upper transfer guide for leading the sheet from the pair of registration rollers to the transfer roller. In addition, a conveyance regulating member regulates a conveying direction of the sheet conveyed by the pair of registration rollers and brings the sheet into contact with the upper transfer guide.

22 Claims, 10 Drawing Sheets

SHEET CONVEYING APPARATUS AND IMAGE FORMING APPARATUS

BACKGROUND OF THE INVENTION

1. Field of the Invention

The present invention relates to an electrophotography type or electrostatic photography type image forming apparatus such as a copying apparatus, a laser beam printer and a facsimile, and a sheet conveying apparatus to be applied to such an image forming apparatus.

2. Related Background Art

A conventional image forming apparatus will be described with reference to FIG. 12. FIG. 12 is a configurational diagram of a laser beam printer configured as the conventional image forming apparatus. Description will be made of an overall configuration and functions of the laser beam printer.

In FIG. 12, a feed cassette 13 which contains loaded sheets S is disposed in a lower section of a main body of the laser beam printer. The feed cassette 13 is configured to be detachable from and attachable to the main body of the laser beam printer.

Reference numeral 14 denotes a feed roller which feeds the sheets S loaded in the above described feed cassette 13 one by one from an uppermost side. Reference numeral 15 denotes a guide member which guides the sheet S fed by the above described feed roller 14.

Reference numeral 16 denotes a conveying roller and reference numeral 17 denotes a driven runner. The conveying roller 16 and the driven runner 17 constitute a conveying roller pair. Rollers 1 and 2 are a registration roller pair comprising an upper registration roller 1 and a lower registration roller 2 which correct a skew feed of the sheet S by allowing a leading end of the sheet S to strike against a nip portion of the registration roller pair in a stop condition to form a loop of the sheet S, and then rotate at a predetermined timing to convey the sheet S to image forming means.

A process cartridge 80 is detachably mounted in the main body of the printer. Mounted in the process cartridge 80 is a photosensitive drum 8 as well as a cleaner 81, a developing device 82, a primary charger (not shown) or the like which are disposed around the photosensitive drum 8.

Reference numeral 18 denotes a laser scanner which scans a laser beam in correspondence to image information and performs write (electrostatic latent image formation) on the photosensitive drum 8. A latent image formed on a circumferential surface of the photosensitive drum 8 is developed by the developing device 82 into a developer (toner) image. Reference numeral 9 denotes a transfer roller which is in pressure contact with the above described photosensitive drum 8 and transfers the developer (toner) image from the photosensitive drum 8 to the sheet S while the sheet S is passing between the transfer roller 9 and the photosensitive drum 8. The process cartridge 80, the transfer roller 9, a fixing device or the like described later compose the image forming means for forming an image on the sheet.

Reference numeral 19 denotes a conveying guide which leads the sheet S to the fixing device after the image is transferred to the sheet S. The fixing device which functions to fix the image (toner image) transferred to the sheet S has a fixing roller 20, a pressure roller 21, a fixing discharge roller pair 22 or the like. The sheet S is conveyed to a discharge roller pair 24 by a conveying roller pair 23 and discharged outside the printer after image fixing with a surface of the sheet S on which the image is formed facing downward.

Reference numeral 25 denotes a discharge tray which is formed on a top surface of the main body of the printer for loading and holding the sheet S which is discharged outside the printer after the image fixing.

Description will be made of image forming operations of the laser beam printer configured as described above. When image formation is designated from a host computer (not shown), the feed roller 14 first rotates, and the sheets S are fed one by one from the uppermost sheet in the feed cassette 13 and guided by the guide member 15 to the conveying roller pair consisting of the conveying roller 16 and the driven runner 17 and the registration roller pair.

The registration roller pair conveys the sheet S between the photosensitive drum 8 and the transfer roller 9 at a timing registered with an image formed on the photosensitive drum 8 and an image (toner image) is transferred to the sheet S while the sheet S is passing between the photosensitive drum 8 and the transfer roller 9.

After transferring the image, the sheet S is conveyed to the fixing device along a conveying guide 19, and the transferred image is fixed by applying heat and a pressure while the sheet S is passing between the fixing roller 20 and the pressure roller 21.

After fixing the image, the sheet S is conveyed by the fixing discharge roller 22 and further discharged and loaded into the discharge tray 25 by the discharge roller pair 24.

A description will be made of a sheet conveying device in detail with reference to FIGS. 12 and 13. FIG. 13 is a schematic diagram of an image forming station of the laser beam printer shown in FIG. 12.

The sheet S which is fed from the feed cassette 13 by the feed roller 14 passes through the conveying roller pair consisting of the conveying roller 16 and the driven runner 17, and is fed into the nip of the registration roller pair consisting of the upper registration roller 1 and the lower registration roller 2 in a stop state of rotating.

The registration roller pair is under a pressure and stops conveyance of the sheet S at an entrance of the nip, thereby allowing the sheet S to form a loop when a leading end of the sheet S is sent into the nip portion of the registration roller pair.

When the registration roller pair starts rotating once again, the sheet S passes between a first sheet guide member 6 and a second sheet guide member 7 and sent into a nip formed by the photosensitive drum 8 and the transfer roller 9.

However, the above described conventional technique poses problems which are described below. That is, it has become general to print high quality images such as photographic images directly on a thick sheet of paper or the like with printers as laser beam printers are configured to operate at higher speeds and form images of higher qualities.

In FIG. 13, the sheet S which is advanced toward transferring means by the registration roller pair is led into the transferring means by the upper and lower sheet guide members 6 and 7. When the sheet S is led into the transferring means, the leading end of the sheet S strikes against the photosensitive drum 8 and then the sheet S is led into a transfer nip.

When the sheet S is a thick sheet of paper in particular, a strong impact is imparted to the photosensitive drum 8 at a write time with a laser, thereby producing an adverse influence on an image. Furthermore, a halftone image may be disturbed due to vibrations of the drum at a developing position which is a position of a developing roller and the photosensitive drum at an instant at which a leading end of the sheet strikes against the photosensitive drum 8, a position at which the photosensitive drum 8 is irradiated with the laser or a charging position at which the photosensitive drum is charged.

Furthermore, an influence on an image is more remarkable as the higher a speed of a printer, the higher a conveying speed of the sheet.

Furthermore, printers have nowadays high resolutions of 1200 dpi and 2400 dpi for enhancing image qualities. The influence on the image due to the impact is more remarkable at a higher resolution. Furthermore, a sheet which is not the thick sheet of paper may produce an influence on an image.

Furthermore, frequently used nowadays as means for transferring a toner image from a photosensitive drum to a sheet is transferring means which uses a contact rotating type transferring member, or the so-called transfer roller, which is brought into contact with a photosensitive drum, subjected to voltage application, and is used for sandwiching and conveying the sheet in a transfer position which is a nip portion between the photosensitive drum and the transfer roller, thereby electrostatically transferring a toner image from the photosensitive drum to the sheet from viewpoint that the transfer roller provides advantage to simplify and stabilize a sheet conveying path and other advantages at the same time.

Though a resistance value of the transfer roller is adjusted to a value on the order of $1\times10^{6}$ to $1\times10^{10}$ Ω, a transfer roller which is proposed nowadays is configured by disposing an elastic layer around an outer circumferential surface of an electrically conductive core metal and imparting an electrical conductivity to this elastic layer.

Furthermore, the resistance of the transfer roller is liable to change dependently on temperatures and humidities of atmospheric environments and a change in the resistance of the transfer roller induces improper transfer, explosive splash, paper trace or the like.

In order to prevent the improper transfer, paper trace or the like from being caused due to the change in the resistance of the transfer roller, there is adopted "control of transferring voltage to be applied" which measures a resistance value of the transfer roller and appropriately controls a transferring voltage to be applied to the transfer roller dependently on a measured result.

Description will now be made of a conventional image forming apparatus with reference to FIG. 14. FIG. 14 is a schematic side view of a transfer position used in the conventional image forming apparatus. Reference character S denotes a transfer material used as a sheet, reference numeral 8 denotes a photosensitive drum, reference numeral 50 denotes a registration roller pair consisting of an upper registration roller 1 and a lower registration roller 2, reference numeral 7 denotes a lower transfer guide, reference numeral 6 denotes an upper transfer guide, reference numeral 9 denotes a transfer roller, reference numeral 26 denotes a guide support member and reference numeral 3 denotes a charge eliminating brush.

FIG. 14 shows a conveying path for the transfer material S between the registration roller pair 50 and the transfer position. The conventional image forming apparatus is mostly configured to lead the transfer material S into the transfer position along the photosensitive drum 8 upstream of the transfer nip while raising the transfer material S above a tangential line on the transfer nip with the lower transfer guide 7 and the upper transfer guide 6.

This configuration prevents image splash at a transfer time and if the transfer material S is led into the transfer position along the transfer roller 9, a toner image on the photosensitive drum 8 will be transferred before the toner image enters the transfer position under an influence due to an electric field produced between the transfer roller 9 to which a bias voltage is applied and the photosensitive drum 8, thereby allowing an image splash phenomenon (pre-transfer phenomenon) to occur.

Furthermore, the lower transfer guide 7 which is made of an electrically conductive material is capable of providing an electric field shielding effect. Since a higher splash preventing effect is obtained by disposing the lower transfer guide 7 used for shielding an electric field at a position as close as possible to the transfer roller 9 and the transfer position, the lower transfer guide 7 is configured to be swung by a guide support member 26 as exemplified in FIG. 14 while following a motion of the transfer roller 9 and a system is used to enhance positional precision of the lower transfer guide 7 relative to the transfer roller 9.

However, the conventional technique described above poses problems which are described below. In FIG. 14, the transfer material S which is advanced toward the transfer position by the registration roller pair 50 is led into the transfer position by the lower transfer guide 7 and the upper transfer guide 6.

After the transfer material S is led into the transfer position, a leading end of the transfer material 5 strikes against a position 30 of the photosensitive drum 8 and then the transfer material S is led into the transfer nip.

At this time, the transfer material S which is a thin sheet of paper poses no problem, but the transfer material S which is a thick sheet of paper applies an impact to the photosensitive drum 8. A printer which has a higher speed conveys the transfer material S at a higher speed and produces a larger influence on an image.

Furthermore, printers nowadays have resolutions as high as 1200 dpi and 2400 dpi for obtaining images of high qualities. At a higher resolution, the impact produces a more remarkable influence on an image. Furthermore, even a transfer material which is not a thick sheet of paper may produce an influence on an image.

SUMMARY OF THE INVENTION

It is therefore an object of the present invention to provide a sheet conveying apparatus and an image forming apparatus which make stabilization of a sheet conveyance in printing images to various sheets, thick sheets of paper in particular, compatible with images of high qualities.

In order to attain the above described object, the sheet conveying apparatus according to the present invention comprises transferring means which transfers a developer developed as an electrostatic latent image on a photosensitive member to a sheet, conveying means which sandwiches the sheet in a conveying nip formed by a rotary member pair and conveys the sheet to the above described transferring means, a sheet guide member which leads the sheet from the above described conveying means to the transferring means, and conveyance regulating member which regulates a conveying direction of the sheet conveyed by the above described conveying means and brings the sheet into contact with the above described sheet guide member.

Furthermore, the above described conveyance regulating member comprises a guide member which regulates a conveying direction of the sheet conveyed by the above described conveying means and guides the sheet.

Furthermore, the above described conveyance regulating member comprises an elastic guide member and regulates the conveying direction of the sheet by urging the sheet which is in contact with the above described guide member.

Furthermore, the above described elastic guide member comprises a conveyance guide portion which extends from a portion supported by a support member supporting the above described guide member and is in contact with the above described sheet, and at least a portion of the above described conveyance guide portion has elasticity.

Furthermore, the above described elastic guide member is hinged to the support member so as to swing which supports the above described guide member and comprises a spring portion which is flexed when the elastic guide member is brought into contact with the above described sheet.

Furthermore, the above described conveyance regulating member comprises a rotary member which is brought into contact with the above described sheet.

Furthermore, the above described conveyance regulating member has electrical conductivity.

Furthermore, the above described conveyance regulating member comprises an electrically conductive fibrous brush.

Furthermore, the above described sheet guide means comprises a first sheet guide member disposed on a side of the above described photosensitive member and a second sheet guide member disposed on a side opposed to the above described first sheet guide member, and the above described conveyance regulating member is disposed among the above described conveying means and the above described first sheet guide member and second sheet guide member at a position on a side of the above described second sheet guide member.

Furthermore, the above described sheet guide member is made of an electrically conductive material and comprises a sheet tailing end regulating member made of an insulating material which regulates a trailing end of the sheet at an upstream end in a conveying direction of the above described sheet and on a side opposite to the above described conveyance regulating member.

Furthermore, the above described transferring means is a rotary member which sandwiches and conveys the above described sheet while being in contact with the above described photosensitive member.

Furthermore, the image forming apparatus according to the present invention comprises image forming means which forms an image on the sheet conveyed by the above described sheet conveying apparatus using the above described photosensitive member and the above described transferring means.

Furthermore, the image forming apparatus according to the present invention comprises a process cartridge which comprises at least the above described photosensitive member and which is detachably mountable in a main body of the image forming apparatus, and the above described process cartridge comprises the above described sheet guide member.

Furthermore, the present invention has another object to provide an image forming apparatus which is capable of stabilizing a sheet conveyance in forming an image on various kinds of sheets such as a thick sheet and enhancing qualities of formed images.

In order to attain the above described object, the image forming apparatus according to the present invention comprises a pair of conveying members for sandwiching and conveying a sheet on which an image is to be formed, an image bearing member for bearing an image to be formed on the above described sheet, and transferring means to be brought into contact with the above described image bearing member for transferring a toner image on the above described image bearing member to the above described sheet, the image forming apparatus characterized by guide means which guides the above described sheet conveyed by the above described pair of conveying members to a transfer nip of the above described image bearing member and the above described transferring means, and a conveyance regulating member which regulates a conveying direction of the sheet conveyed from a conveying nip of the above described pair of conveying members, in that a straight line passing the conveying nip of the above described pair of conveying members and a sheet contact point on the above described conveyance regulating member intersects with the above described guide means.

Furthermore, the above described guide means comprises a sheet trailing end regulating member which comes into contact with the sheet having passed through the above described conveying nip and regulates a trailing end of the sheet.

Furthermore, the above described sheet trailing end regulating member is made of an electrically insulating material.

Furthermore, the above described transferring means is a transfer roller which comprises a support means which is hinged so as to swing by a rotary shaft of the above described transfer roller and urged in a predetermined direction by elastic means, and the above described guide means is formed integrally with the above described support means.

Furthermore, the above described guide means is configured by a wall surface of the process cartridge detachably mountable in the main body of the above described image forming apparatus.

In the image forming apparatus having the above described configuration, the conveyance regulating member is disposed so that a line connecting a sheet contact point on the conveyance regulating member to the conveying nip is directed above a tangential line on the conveying nip and when the pair of conveying members and the guide means are disposed so that a straight line passing the conveying nip and a vertex of the conveyance regulating member intersects with a conveying surface of the transferring means, the sheet is conveyed to the transfer position along the guide means and the leading end of the sheet strikes against the image bearing member at a small angle, whereby a striking impact of the sheet is weaker.

Furthermore, when the sheet trailing end regulating member is integrated with the guide means between the conveyance regulating member and the conveying nip, for example, it is possible to retard a sheet rising after the trailing end of the sheet has passed through the pair of conveying members, thereby stabilizing conveyance of the sheet.

Furthermore, when the sheet trailing end regulating member is made of an electrically insulating material such as resin, rubber or porcelain and charge eliminating means is disposed, for example, after the pair of conveying members, it is possible to insulate the charge eliminating means from the guide means at a bias voltage application time to the guide means, thereby enhancing a precision of image formation on the sheet.

Furthermore, when the guide means is integrated with the support means and the support means is hinged by the transfer roller shaft so as to swing, it is possible to enhance a positional precision of the guide means.

Furthermore, convenience of the image forming apparatus can be enhanced by utilizing a process cartridge which includes the image bearing member, etc. and which is detachably mountable in the main body of the image forming apparatus, and the image forming apparatus which has a simple configuration and can be manufactured at a low cost can be realized by using a wall surface of this process cartridge as the guide means.

BRIEF DESCRIPTION OF THE PREFERRED EMBODIMENTS

Figure 1:
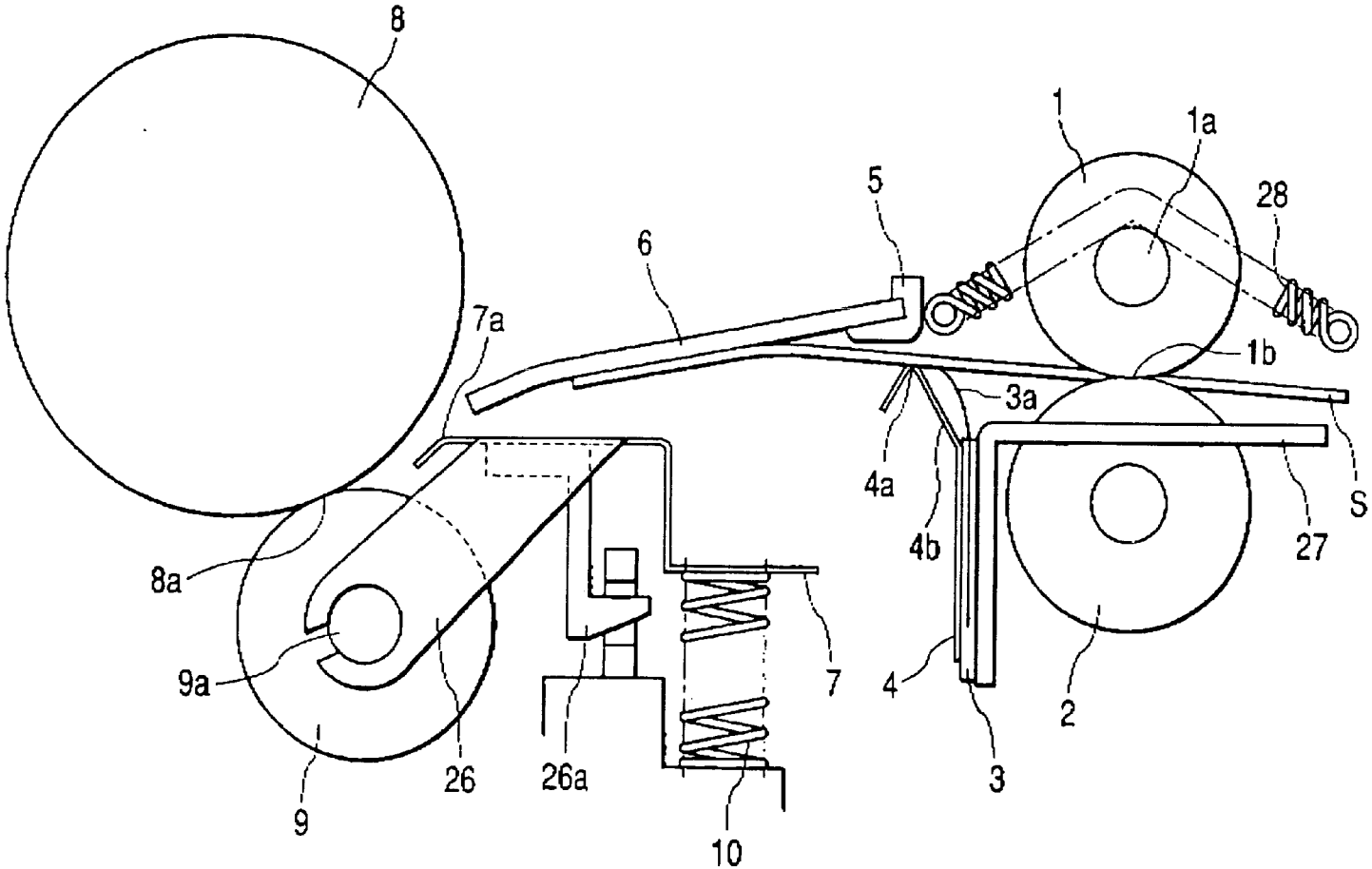
FIG. 1 is a partial configurational diagram showing a first embodiment of an image forming apparatus according to the present invention.

Now, preferable embodiments of the present invention will be described in detail as illustrative examples with reference to the accompanying drawings. However, dimensions, materials, forms, relative dispositions or the like described in these embodiments are not limitative of a scope of the present invention unless there items are described specifically in particular.

Furthermore, the members which are shown in the drawings used for description of the conventional techniques explained above and members which are similar to those shown in the above described drawings will be denoted by the same reference numerals. Furthermore, descriptions of the embodiments of the image forming apparatus according to the present invention which are explained below also serve as descriptions of embodiments of the sheet conveying apparatus according to the present invention.

(First embodiment)

Figure 12:
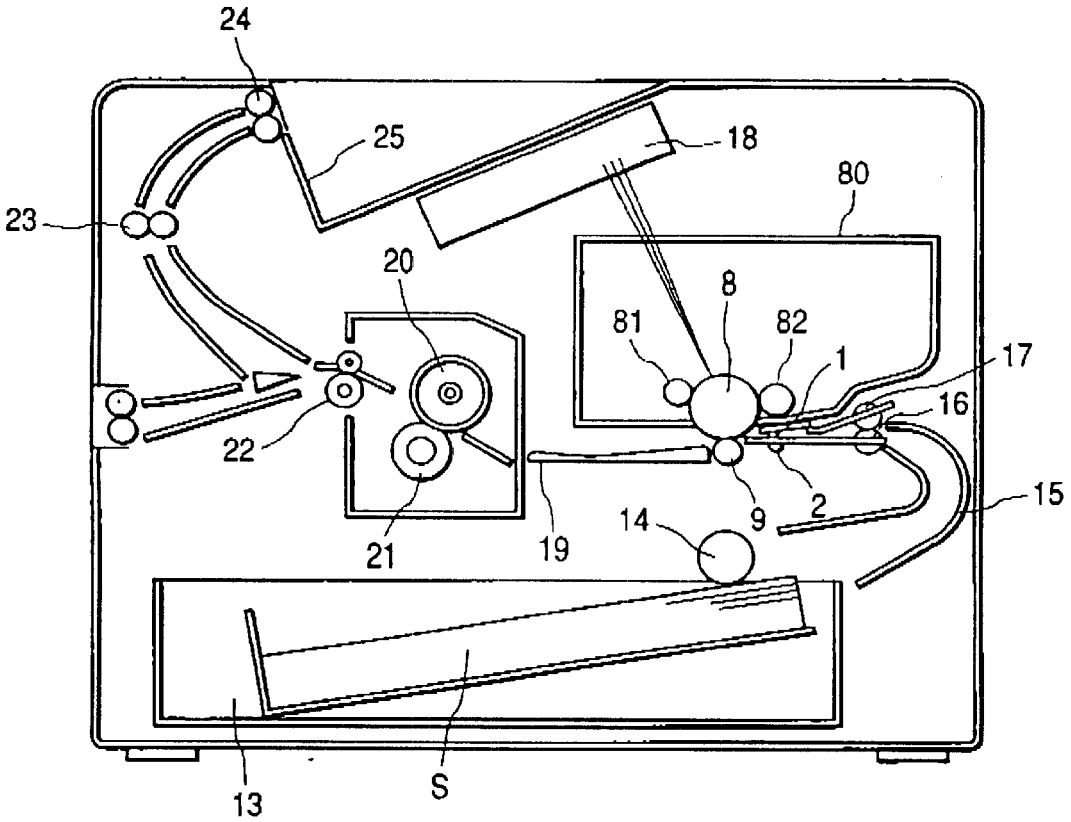
FIG. 12 is a configurational diagram of a laser beam printer configured as a conventional image forming apparatus.
Figure 13:
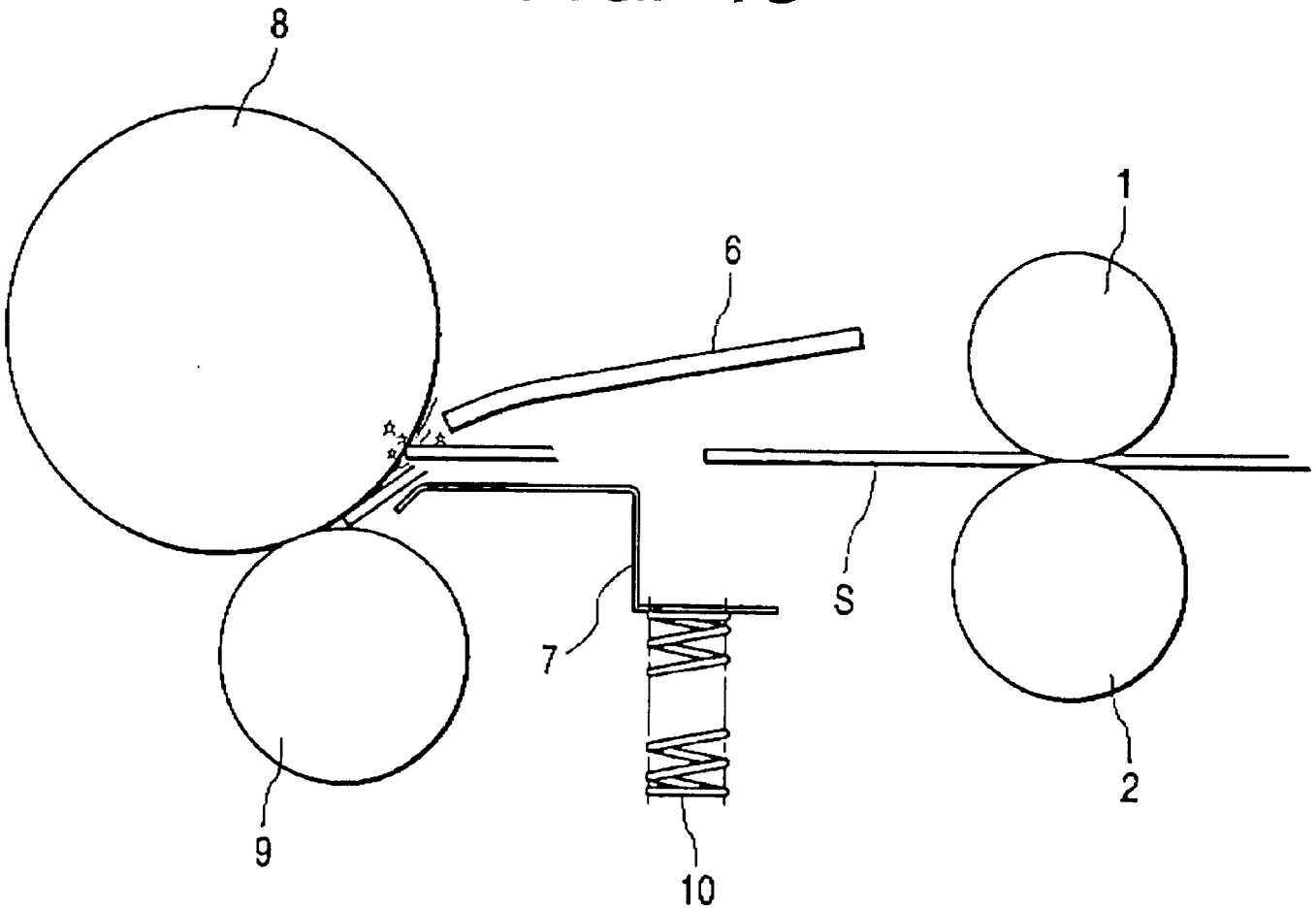
FIG. 13 is a schematic diagram of an image forming station of the laser beam printer shown in FIG. 12.
Figure 14:
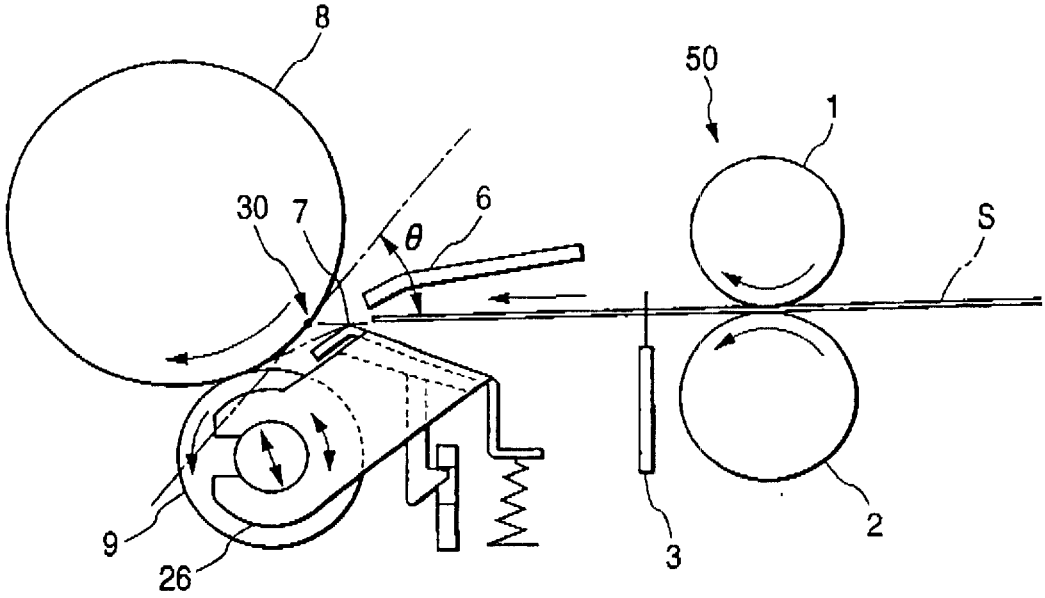
FIG. 14 is a schematic side view of a transfer position used in the conventional image forming apparatus.

First, description will be made of a first embodiment of the image forming apparatus according to the present invention. The first embodiment is application of the present invention to an image forming apparatus which is similar to the image forming apparatus shown in FIG. 12 used for describing the conventional technique. Component members common to FIG. 12 will therefore be denoted by the same reference numerals and not described in particular. FIG. 1 is a partial configurational diagram of the first embodiment of the image forming apparatus according to the present invention.

In FIG. 1, a roller 1 and a roller 2 are component members of a registration roller pair used as a rotary member pair of conveying means which is a component member of the image forming apparatus according to the present invention: the reference numeral 1 is an upper registration roller which is a metal roller and the reference numeral 2 is a lower registration roller which is a rubber roller.

The upper registration roller 1 is urged toward the lower registration roller 2 by elastic members 28 which are engaged with both ends 1*a* of the roller 1, and the upper registration roller 1 and the lower registration roller 2 form a nip. The registration roller pair once stops a sheet S which is conveyed from a feed cassette with a nip portion 1*b* of the registration roller pair and conveys the sheet S downstream by rotatingly driving the sheet S so as to match with an exposure timing.

Reference numeral 3 denotes a charge eliminating brush adopted as a component member of the image forming apparatus according to the present invention which functions as a brush performing charge elimination from the sheet S before transferring. The charge eliminating brush 3 is disposed on a downstream of the registration roller pair and is attached to a lower registration guide 27 which is a support member adopted as a component member of the image forming apparatus according to the present invention so that only a brush portion 3*a* protrudes above the lower registration guide 27. A length of the charge eliminating brush 3 is set so that the brush portion 3*a* comes into contact with the sheet S which is being conveyed.

Reference numeral 4 denotes a conveyance regulating member which has a guide member adopted as a component member of the image forming apparatus according to the present invention. The conveyance regulating member 4 has also a role of a conveyance guide, a conveyance guide portion 4*b* has an angle shape and a vertex 4*a* of the conveyance guide portion 4*b* is disposed above a path through which the sheet S is to be conveyed when the conveyance regulating member 4 is not disposed.

The conveyance regulating member 4 is secured to the lower registration guide 27 so as to sandwich the charge eliminating brush 3 between the lower registration guide 27 and the conveyance regulating member 4.

Both the charge eliminating brush 3 and the conveyance regulating member 4 are grounded to the main body since these members are secured to the lower registration guide 27.

A leading end of the sheet S which is conveyed from the registration roller pair while being in contact with the brush portion 3*a* of the charge eliminating brush 3 and subjected to charge elimination strikes against a slant surface of the conveyance guide portion 4*b* of the conveyance regulating member 4 and is guided in a conveying direction along the slant surface.

The vertex 4*a* of the conveyance regulating member 4 and a nip portion 1*b* form a path, and the sheet S which exceeds the vertex 4*a* of the conveyance regulating member 4 is conveyed along the path.

Reference numeral 6 denotes an upper transfer guide adopted as a component member of the image forming apparatus according to the present invention which functions as a first sheet guide member of a sheet guide member. The upper transfer guide 6 has a role to guide the conveyed sheet S to a photosensitive drum 8 which is image forming means adopted as a component member of the image forming apparatus according to the present invention.

The leading end of the sheet S which has exceeded the vertex 4*a* advances along a path (tangential line) connecting the nip 1*b* to the vertex 4*a,* is guided above the vertex 4*a* under an influence due to a rigidity of the sheet of paper and attains to the upper transfer guide 6.

The sheet S which strikes against the upper transfer guide 6 is guided along the upper transfer guide 6 to the photosensitive drum 8 while receiving a force which presses the sheet S to the upper transfer guide 6. The upper transfer guide 6 has a shape which is bent downward on a downstream side of the path.

Accordingly, the sheet S which is conveyed along the upper transfer guide 6 strikes against the photosensitive drum 8 at a small advancing angle and is sent into a transfer nip while lessening an impact applied to the photosensitive drum 8.

Reference numeral S denotes a sheet trailing end regulating member attached to an upstream end of the upper transfer guide 6. The sheet trailing end regulating member 5 is attached so that a lower end is located above the path for the sheet S connecting the nip 1*b* to the vertex 4*a* and does not close the path.

The conventional technique stabilizes a behavior of the sheet S while the sheet S is conveyed while being sandwiched between the transfer nip and the nip 1*b*, but once the trailing end of the sheet S has passed through the nip 1*b*, the trailing end springs up and the behavior is disturbed. Furthermore, the conveyance regulating member 4 makes disturbance of the behavior more unstable and an image is disturbed when a thick sheet of paper is conveyed.

In the first embodiment, the sheet trailing end regulating member 5 regulates the sheet S, thereby preventing the trailing end of the sheet S and the behavior from springing up and disturbed immediately after the trailing end has passed through the nip 1*b*.

Since the brush portion 3*a* is brought near the upper transfer guide 6 and leak may be caused from the charge eliminating brush 3 when the sheet S attains to the charge eliminating brush 3 and depresses the brush portion 3*a* or when the sheet S has passed beyond the charge eliminating brush 3 and the brush portion 3*a* starts returning, the sheet trailing end regulating member 5 is made of an insulating material so that this member 5 has also a role to prevent leak from the charge eliminating brush 3.

A lower transfer guide 7 which is a second sheet guide member of a sheet guide member adopted as a component member of the image forming apparatus according to the present invention is attached to a support member 26 so as to rotate and swing around a transfer roller shaft 9*a* and is positioned by an elastic member 10 urging the lower transfer guide 7 and a positioning mechanism 26*a*.

While the sheet S is sandwiched and conveyed in a transfer nip 8*a,* a path is determined by the transfer nip 8*a* and a position (tangential line) of a vertex 7*a* of the lower transfer guide 7.

Table 1 lists results obtained by comparing image blur on printing halftone images on a thick sheet of paper by the image forming apparatus according to the first embodiment using the above described sheet conveying apparatus with that in the conventional example.

TABLE 1

| Conveying speed | Kind of paper (basis weight) | | | | | |
|---|---|---|---|---|---|---|
| | Conventional example | | | First embodiment | | |
| | 64 g | 128 g | 216 g | 64 g | 128 g | 216 g |
| 100 mm/sec | ○ | ○ | Δ | ○ | ○ | ○ |
| 150 mm/sec | ○ | Δ | Δ | ○ | ○ | Δ |
| 200 mm/sec | Δ | x | x | ○ | Δ | Δ |

○: None
Δ: slight
x: Remarkable

The image blur was evaluated by setting the image forming apparatuses at several optional sheet conveying speeds and using kinds of paper having different basis weights. Striking of a leading end of a sheet of paper against a drum produced more remarkable image blur (developing nip) at a higher speed and at a heavier basis weight in the conventional example, whereas the sheet conveying apparatus using the configuration according to the first embodiment was capable of correcting image blur as shown in Table 1.

(Second embodiment)

Figure 2:
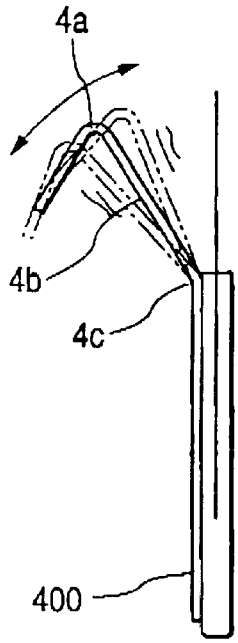
FIG. 2 is a configurational side view of a conveyance regulating member used in a second embodiment of the image forming apparatus according to the present invention.
Figure 3:
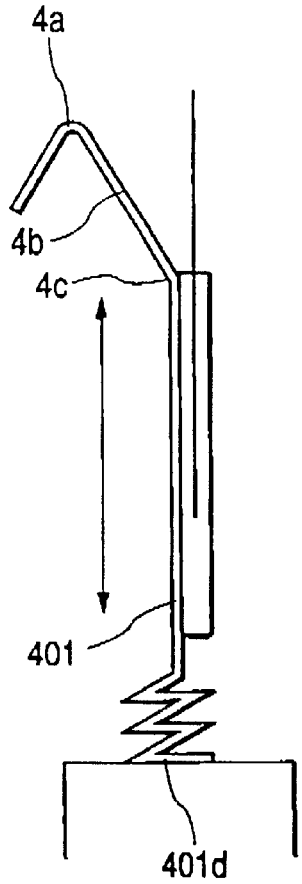
FIG. 3 is a configurational side view of the conveyance regulating member used in the second embodiment of the image forming apparatus according to the present invention.

Then, description will be made of a second embodiment of the image forming apparatus according to the present invention. Since the second embodiment is different from the above described first embodiment of the image forming apparatus according to the present invention only in a configuration of the conveyance regulating member as shown in FIGS. 2 and 3, however, description which is made using FIG. 1 is applicable to the second embodiment with no modification. Accordingly, the following description will be made while replacing the conveyance regulating member shown in FIG. 1 with a conveyance regulating member according to the second embodiment. FIGS. 2 and 3 are configurational side views of conveyance regulating members used in the second embodiment of the image forming apparatus according to the present invention.

In FIG. 2, reference numeral 400 denotes a conveyance regulating member having elasticity which corresponds to the conveyance regulating member 4 shown in FIG. 1. This conveyance regulating member 400 is configured to be flexed at a root 4*c* of a conveyance guide portion 4*b*.

As shown in FIGS. 1 and 2, the sheet S is sent from the registration nip over the conveyance regulating member 400 and led to the photosensitive drum 8 along the upper transfer guide 6 for image transferring.

Since the conveyance regulating member 400 applies high resistance and produces an influence on a peripheral speed and a conveying torque of the sheet S while the sheet S is sandwiched and conveyed by the registration nip and the transfer nip, elasticity is imparted to the root 4*c* of the conveyance guide portion 4*b* so that it is flexed.

When a load not lower than a predetermined level (overload) is applied to the conveyance regulating member 400 during conveyance of the sheet S, the root 4*c* is flexed and the vertex 4*a* is lowered, thereby lessening conveyance resistance.

Then, a conveyance regulating member having another configuration which is to be used in the second embodiment will be described with reference to FIG. 3. In FIG. 3, reference numeral 401 denotes an elastic conveyance regulating member which is hinged so as to be swingable in an up-down direction and when a leaf spring like portion 401*d* which is a spring portion adopted as a component of the image forming apparatus according to the present invention is flexed, the conveyance regulating member 401 swings up and down.

Since the conveyance regulating member 401 applies the high resistance and may produce any influence on the sheet S and the main body during the conveyance of the sheet S as described above, the leaf spring like portion 401*d* is flexed and the vertex 4*a* is lowered to lessen conveyance resistance when the conveyance regulating member 401 is overloaded.

Table 2 lists results obtained by measuring peripheral speeds (sub-portion magnification) of sheets in the second embodiment and the above described first embodiment using a thick sheet of paper having a heavy basis weight (216 g paper).

The sub-portion magnification is defined as a ratio expressed in percent of a difference between a moving speed of a sheet in a conveying direction of the sheet and a moving speed of an image on the image bearing member divided by the moving speed of the image on the image bearing member.

TABLE 2

| Kind of paper | First embodiment | | | Second embodiment | | |
|---|---|---|---|---|---|---|
| (basis weight) | 64 g | 128 g | 216 g | 64 g | 128 g | 216 g |
| Magnification | 0% | −0.1% | −0.2% | 0% | 0.02% | 0.05% |

When the peripheral speed (sub-portion magnification) of the sheet conveying apparatus according to the second embodiment is compared with that of the sheet conveying apparatus according to the first embodiment, the sheet conveying apparatus according to the second embodiment has a peripheral speed higher than that of the sheet conveying apparatus according to the first embodiment which has higher conveyance resistance as shown in Table 2, thereby producing no compressed image.

Furthermore, Table 3 lists results obtained by evaluating the second embodiment and the above described first embodiment for banding.

TABLE 3

| | First embodiment | Second embodiment |
|---|---|---|
| Motor torque low | x | Δ |
| Motor torque high | Δ | ○ |

○: None
Δ: Slight
x: Remarkable

The second embodiment is capable of not only providing an effect similar to that of the above described first embodiment but also lowering a conveying torque as shown in Table 3, thereby lessening a load on a motor, reducing proper vibrations of units and gears, and preventing banding even on a thick sheet of paper.

(Third embodiment)

Figure 4:
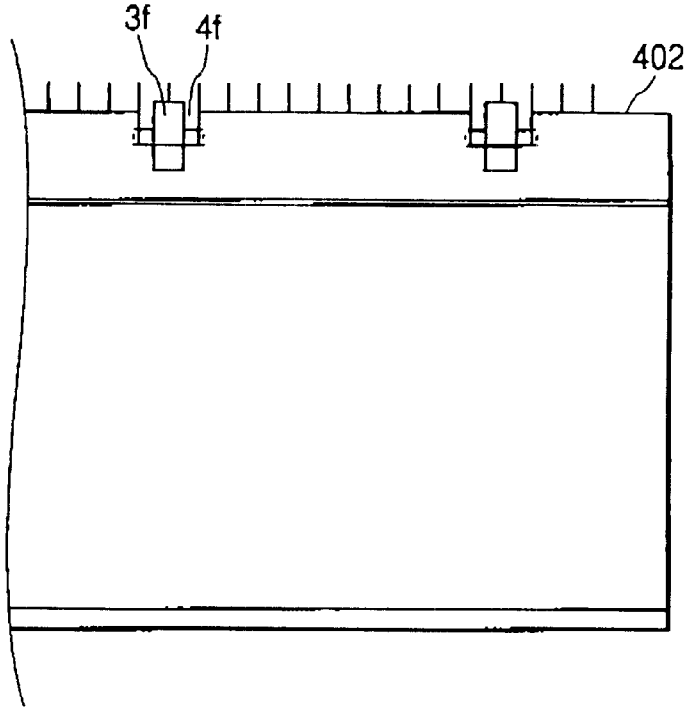
FIG. 4 is a configurational front view of a conveyance regulating member used in a third embodiment of the image forming apparatus according to the present invention.
Figure 5:
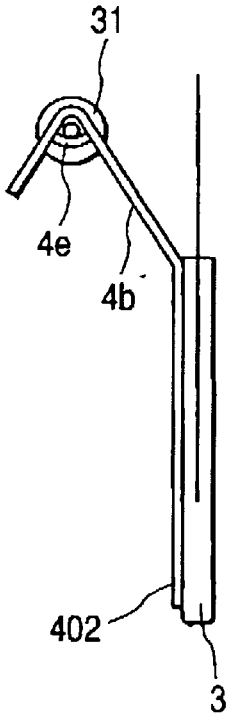
FIG. 5 is a configurational side view of the conveyance regulating member used in the third embodiment of the image forming apparatus according to the present invention.
Figure 6:
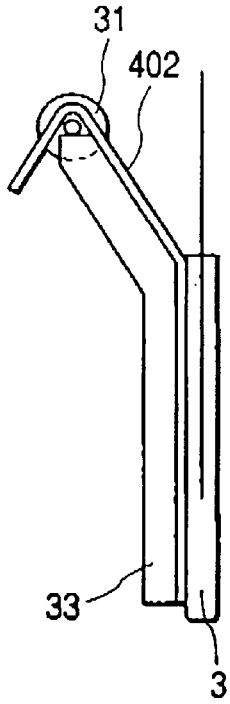
FIG. 6 is a configurational side view of the conveyance regulating member used in the third embodiment of the image forming apparatus according to the present invention.

Now, a third embodiment of the image forming apparatus according to the present invention will be described with reference to FIGS. 4, 5 and 6. However, the description which has been made above using FIG. 1 is applicable to the third embodiment with no modification since the third embodiment is different from the first embodiment of the image forming apparatus according to the present invention only in a configuration of a conveyance regulating member as shown in FIGS. 4, 5 and 6. Accordingly, description will be made with the conveyance regulating member shown in FIG. 1 substituted for a conveyance regulating member according to the third embodiment. FIG. 4 is a configurational front view of the conveyance regulating member used in the third embodiment of the image forming apparatus according to the present invention, whereas FIGS. 5 and 6 are configurational side views of the conveyance regulating member used in the third embodiment of the image forming apparatus according to the present invention.

In FIGS. 4 and 5, reference numeral 31 denotes a rotary member (runner). In the third embodiment, the rotary member (runner) 31 is disposed on a conveyance guide portion 4*b* of a conveyance regulating member 402 as shown in these drawings. A slit 4*f* is formed in the conveyance regulating member 402, a guide member in the slit 4*f* is formed into a support portion 4*e* for supporting the rotary member (runner) 31 and the rotary member (runner) 31 is retained so as to protrude from the slit 4*f*.

Furthermore, another type conveyance regulating member to be used in the third embodiment will be described with reference to FIG. 6. In FIG. 6, a rotary member (runner) 31 is disposed on a conveyance guide portion 4*b* of a conveyance regulating member 402. Furthermore, a runner holder 33 for holding the rotary member (runner) 31 is disposed in a lower section of a slit 4*f* to dispose the rotary member (runner) 31 in the slit 4*f* and the rotary member (runner) 31 is retained in the slit 4*f*.

The sheet S which has passed through the registration roller pair and is sent to the conveyance regulating member 402 as shown in FIGS. 1 and 4 is guided to be conveyed along the upper transfer guide 6 while reducing resistance produced during conveyance with the rotary member (runner) 31 disposed on the conveyance regulating member 402.

Accordingly, the third embodiment is capable of not only providing an effect similar to that of the above described first embodiment but also avoiding a compressed image, blur, enhancement of a conveying torque or the like.

(Fourth embodiment)

Figure 7:
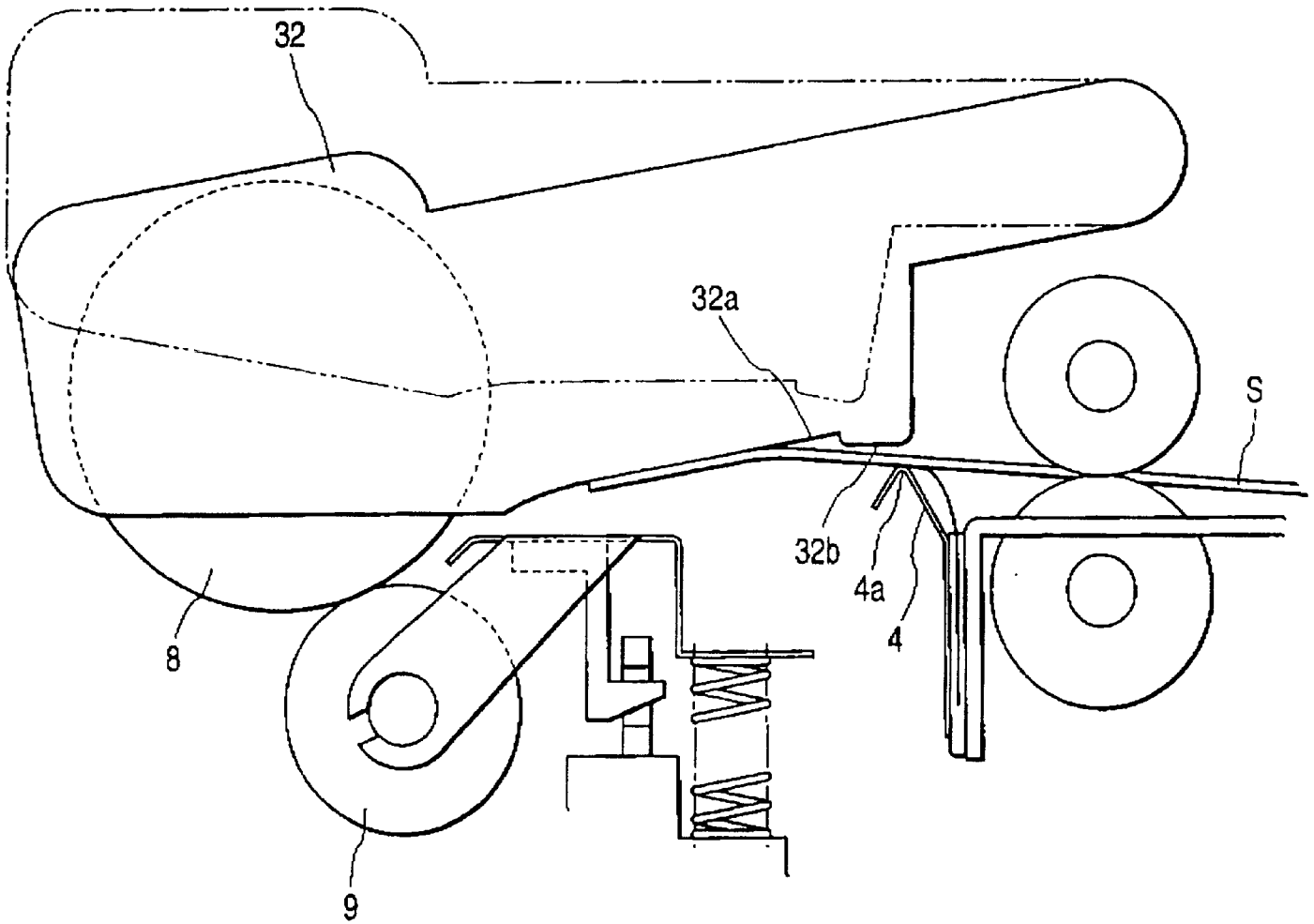
FIG. 7 is a configurational diagram of a fourth embodiment of the image forming apparatus according to the present invention.

Referring now to FIG. 7, description will be made of a fourth embodiment of the image forming apparatus according to the present invention. FIG. 7 is a configurational diagram of the fourth embodiment of the image forming apparatus according to the present invention. The fourth embodiment is an image forming apparatus using a process cartridge.

In FIG. 7, reference numeral 32 denotes a process cartridge which is attachable and detachable in an innermost direction in FIG. 7. A bottom surface 32*a* of the process cartridge 32 has a shape which is bent downward on a downstream side of a path and serves also as a conveyance guide.

A lower end 32*b* of the process cartridge is positioned above a path (tangential line) for the sheet S which is formed by a registration nip and a vertex 4*a*, and serves as a trailing end regulating member. The process cartridge 32 is inserted into the main body (two-dot chain line), lowered to a predetermined position at which the process cartridge forms a nip with a transfer roller and positioned at the redetermined position.

The sheet S which has passed through the registration roller pair and is guided by the conveyance regulating member 4 in a conveying direction is guided into a transfer nip portion along the bottom surface 32*a* of the process cartridge which serves also as the conveyance guide or as a sheet guide member according to the present invention. Furthermore, the lower end 32*b* prevents a behavior of a tailing end of the sheet S from being disturbed immediately after the trailing end has passed through the registration nip.

Needless to say, a conveyance regulating member to be used in the fourth embodiment is not limited to the conveyance regulating member 4 used in the above described first embodiment, and the conveyance regulating member 400, 401 or 402 used in the second or third embodiment may be used in the fourth embodiment.

The fourth embodiment is capable of providing an effect similar to that of the above described first or third embodiment, and since the bottom surface of the process cartridge is used as the sheet guide member, the fourth embodiment makes it possible to reduce the number of parts and lower a manufacturing cost, and facilitates to position the process cartridge relative to the drum with accuracy.

The present invention makes it possible to modify a path for a sheet by changing a position and a height of a vertex of a conveyance regulating member as described above, thereby facilitating to set the sheet path optimum for solving problems of blur, slip, banding or the like.

In the conventional configuration, a leading end of a sheet which has passed through a registration roller pair is conveyed in a condition of an unstable behavior without being guided by a sheet guide in a conveying direction and strikes directly against a drum. When a conveyance regulating member is disposed as in the configuration of the image forming apparatus according to the present invention, the sheet moves in a path along an upper transfer guide, the path prevents a leading end of the sheet which has passed through a registration roller pair from striking directly against a photosensitive drum and the sheet can be fed into a transfer nip along the sheet guide, whereby an impact on the photosensitive drum can be moderated and an influence on an image can be prevented.

Furthermore, when the sheet trailing end regulating member is disposed, it is possible to prevent a trailing end of a sheet which has passed through a registration roller pair from springing up, thereby preventing image blur at the trailing end.

Furthermore, when the sheet tailing end regulating member is made of an insulating material, it is possible to prevent leak from the charge eliminating brush.

Furthermore, when elasticity is imparted to the conveyance regulating member, it is possible to allow the conveyance regulating member to be flexed to prevent an overload when the conveyance regulating member produces high resistance while a sheet is sandwiched and conveyed by the registration nip and the transfer nip, thereby lessening or solving problems of a compressed image, blur, enhancement of a conveying torque or the like.

Furthermore, when the rotary member (runner) is disposed on the conveyance regulating member, it is possible to lower conveyance resistance at a sheet conveyance time with the conveyance regulating member, thereby lessening or solving the above described problems of the compressed image, blur, enhancement of the conveying torque or the like.

Furthermore, when the conveyance regulating member performs also a role to guide a sheet in the conveying direction, it is possible to eliminate charges securely from the sheet by imparting electrical conductivity to the conveyance regulating member or equipping the conveyance regulating member with an electrically conductive fibrous brush.

Furthermore, the bottom surface and the lower end of the process cartridge which serve also as the sheet guide member and the sheet tailing end regulating member respectively make it possible to reduce the number of parts and lower a manufacturing cost, and facilitate to position the process cartridge relative to a drum with accuracy.

(Fifth embodiment)

Figure 8:
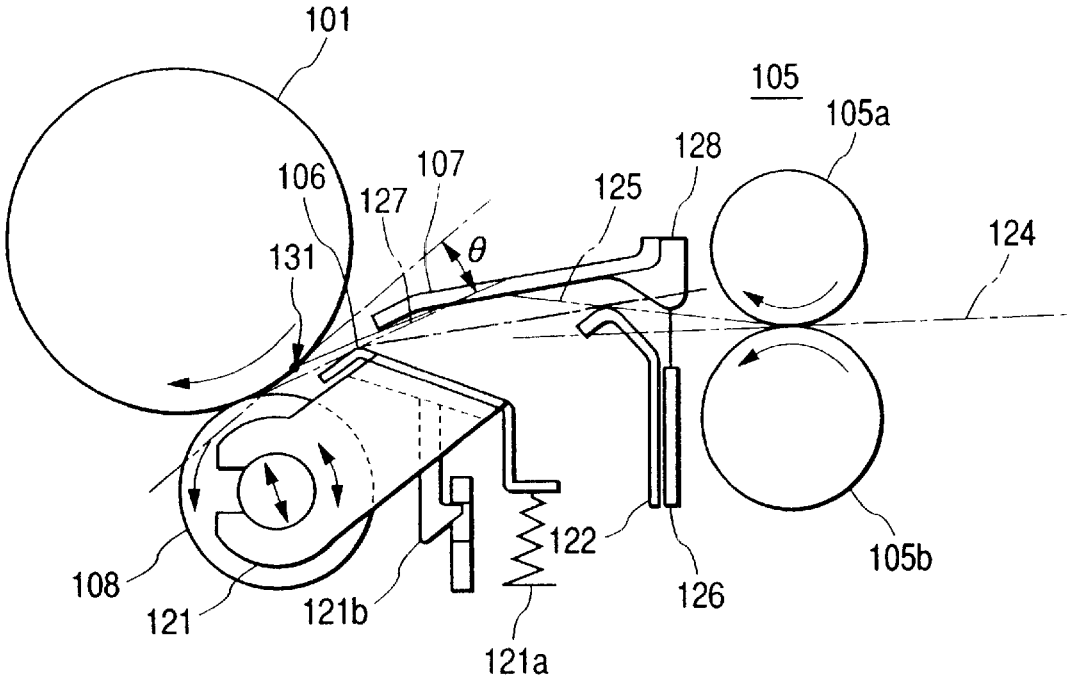
FIG. 8 is a schematic side view of the vicinities of a transfer position in a fifth embodiment of the image forming apparatus according to the present invention.

A fifth embodiment of the image forming apparatus according to the present invention will be described with reference to FIGS. 8 and 9. Referring to FIG. 8 which is a schematic side view of the vicinity of a transfer position of the fifth embodiment of the image forming apparatus according to the present invention and FIG. 9 which is a side view of the fifth embodiment of the image forming apparatus according to the present invention, operations of the image forming apparatus will be described.

Figure 9:
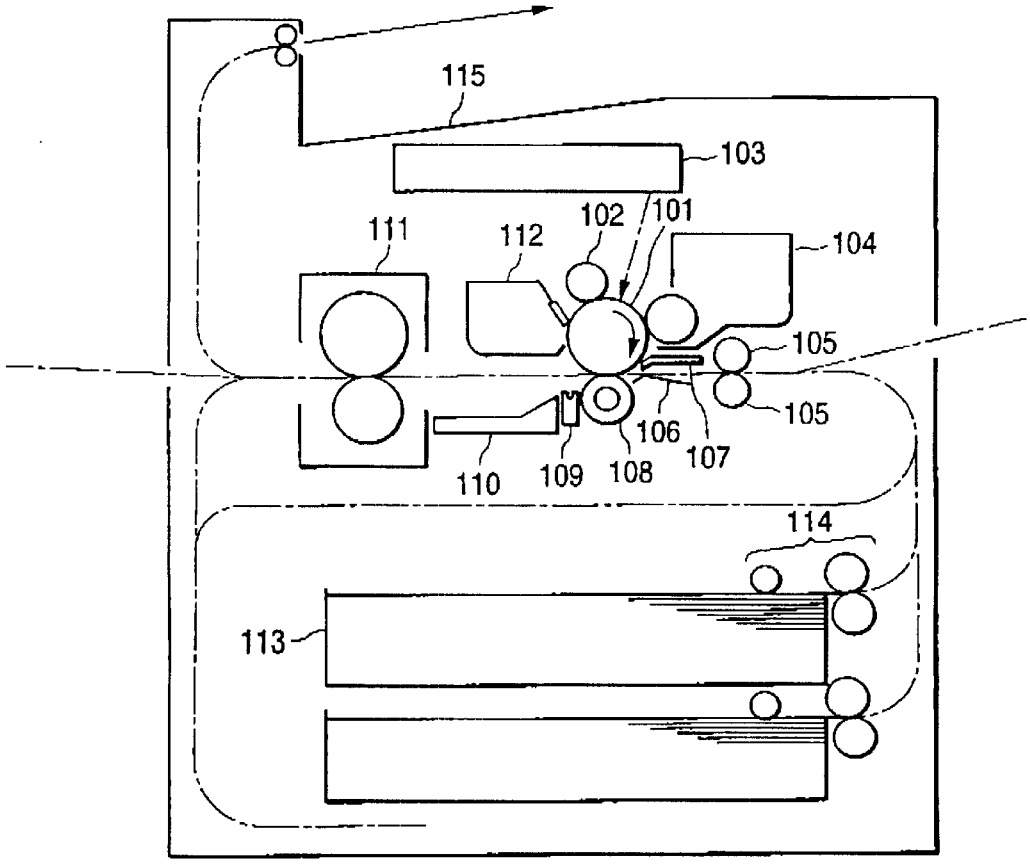
FIG. 9 is a side view of the fifth embodiment of the image forming apparatus according to the present invention.

As shown in FIG. 9, reference numeral 101 denotes a photosensitive drum which serves as an image bearing member according to the present invention, reference numeral 102 denotes a charging roller which uniformly charges the photosensitive drum 101, reference numeral 103 denotes an exposure device which exposes the photosensitive drum 101 and reference numeral 104 denotes a developing device which develops an electrostatic latent image on the photosensitive drum 101 with a toner (developer).

Furthermore, reference numeral 105 denotes a registration roller pair functioning as a pair of conveying members according to the present invention which feeds and conveys a transfer material as a sheet according to the present invention, reference numeral 106 denotes a lower transfer guide which leads the transfer material into a transfer position and reference numeral 107 denotes an upper transfer guide functioning as guide means according to the present invention which leads the transfer material into the transfer position.

Furthermore, reference numeral 108 denotes a transfer roller functioning as transferring means according to the present invention for transferring to the transfer material S an image developed on the photosensitive drum 101 and having an axis which can swing, reference numeral 109 denotes a charge eliminating needle which eliminates charges from the transfer material, reference numeral 110 denotes a conveyance guide for conveying to a fixing device 111 the transfer material to which a developer image has been transferred, reference numeral 111 denotes the fixing device for fixing the developer image transferred to the transfer material and reference numeral 112 denotes a cleaner for cleaning the photosensitive drum 101 by removing residual toner from the photosensitive drum 101.

Furthermore, reference numeral 113 denotes a feed cassette for containing the transfer material, reference numeral 114 denotes a feed roller group for feeding and conveying the transfer material at a registered timing and reference numeral 115 denotes a discharge tray into which discharged transfer materials are rested.

The photosensitive drum 101 is rotatingly driven in a direction indicated by an arrow at a predetermined peripheral speed (process speed). A voltage which consists of a DC bias voltage and an AC bias voltage superposed with the DC bias voltage is applied to the charging roller 102, thereby uniformly charging the photosensitive drum 101 at a predetermined polarity and at a predetermined potential (primary charging).

The exposure device 103 is a laser beam scanner which outputs an on/off modulated laser beam in correspondence to image information input from an external appliance such as an image scanner or a computer (not shown), thereby scanning and exposing a charged surface of the photosensitive drum 101. An electrostatic latent image is formed on the surface of the photosensitive drum 101 by this scanning exposure.

A developer (toner) is supplied from the developing device 104 to the surface of the photosensitive drum 101, thereby visualizing the electrostatic latent image as a toner image.

An electrophotographic image forming apparatus such as a laser beam printer generally uses a reversal developing method which develops an image by adhering a toner to an exposed area.

The feed cassette 113 contains the transfer materials, the feed roller group 114 is driven on the basis of a feed start signal, and the transfer materials are fed one by one from the feed cassette 113, conveyed through the registration roller pair 105 and led at predetermined timings into a transfer position which is a contact nip between the photosensitive drum 101 and the transfer roller 108.

In other words, conveyance of the transfer material is controlled by the registration roller pair 105 so that the predetermined timing is synchronized with a timing at which a leading end of the toner image on the photosensitive drum 101 attains to the transfer position.

The transfer material which is led into the transfer position is sandwiched and conveyed through the transfer position and a constant voltage bias (transfer bias) which is controlled to a predetermined value is applied at this time from a transfer bias applying power supply (not shown) to the transfer roller 108.

Since the transfer bias which has a polarity reverse to that of the toner is applied to the transfer roller 108, the toner image on the photosensitive drum 101 is electrostatically transferred to a surface of the transfer material at the transfer position.

The transfer material to which the toner image has been transferred at the transfer position is separated from the photosensitive drum 101, conveyed and led into the fixing device 111 and subjected to a fixing process which heats and pressurizes the toner image.

On the other hand, the surface of the photosensitive drum 101 from which the transfer material has been separated is cleaned by the cleaner 112 which removes the toner remaining after the transferring and paper dust, and subjected repeatedly to an image formation process. The transfer material which has passed through the fixing device 111 is discharged directly into the discharge tray 115 when a single-surface print is designated.

Then, the vicinities of the transfer position will be described with reference to FIG. 8. In FIG. 8, reference numerals 105*a* and 105*b* denote components of the registration roller pair 105: reference numeral 105*a* being an upper registration roller and 105*b* being a lower registration roller.

Furthermore, reference numeral 122 denotes a conveyance regulating member and reference numeral 126 denotes a charge eliminating brush which eliminates charges from the transfer material before the transferring. Reference numeral 128 denotes a transfer material trailing end regulating member functioning as a sheet trailing end regulating member according to the present invention.

The lower transfer guide 106 is attached to a guide support member 121 so as to rotate and swing around a transfer roller shaft, and is positioned by a spring 121*a* and a positioning mechanism 121*b*.

The transfer material which is fed from the feed cassette 113 is once stopped when being conveyed to the registration roller pair 105 by conveying rollers or the like, bitten by a conveying nip formed by the registration roller pair 105 when the registration roller pair 105 is rotatingly driven in registration with an exposure timing and conveyed toward the transfer position with no treatment.

Conveyance regulating member 122 is disposed so that its vertex is positioned above a nip tangential line on the conveying nip formed by the registration roller pair 105 and raises a path (conveying path for the transfer material).

A raising angle is set so that the transfer material comes into contact with the upper transfer guide 107. The transfer material is led to the transfer position along the upper transfer guide 107 while being pressed to the upper transfer guide 107.

The upper transfer guide 107 has a shape bent downward on a downstream side of the path and is fixed. Since the upper transfer guide 107 has the shape which is bent downward, the transfer material strikes against the vicinity of a position 131 on the surface of the photosensitive drum 101.

At this time, an angle θ between a tangential line on a struck position on the surface of the photosensitive drum 101 and the transfer material can be remarkably smaller than a conventional angle. Furthermore, when the conveyance regulating member 122 is positioned above a nip tangential line 124 on the conveying nip, the transfer material tends to go above a line 125 connecting the conveying nip to the vertex of the conveyance regulating member 122 under an influence due to a rigidity of the trasnfer material.

Since the line 125 intersects with the upper transfer guide 107, the transfer material receives a force which presses the transfer material to the upper transfer guide 107. When the vertex of the conveyance regulating member 122 is positioned higher, a force to lead the transfer material along the upper transfer guide 107 is stronger and the angle θ is smaller, but the transfer material receives a stronger frictional force from the guide and a height of the vertex is to be set within an appropriate range.

When the transfer material is in the transfer nip, on the other hand, a path for the transfer material is determined by a vertex of the lower transfer guide 106. That is, the path is a line 127 connecting the transfer nip to the vertex of the lower transfer guide 106. Though conveyance is stable while the transfer material is bitten by both the transfer nip and the conveying nip, a behavior of the trailing end of the transfer material may be unstable immediately after the trailing end of the transfer material has passed through the conveying nip. When the conveyance regulating member 122 exists, the behavior is more unstable and this unstableness appears as an image when a thick sheet of paper is passed.

The transfer material trailing end regulating member 128 prevents this unstableness. The transfer material tailing end regulating member 128 is set slightly above the line 125.

Since the transfer material trailing end regulating member will intercept a path for the transfer material if the member is set too low, the transfer material trailing end regulating member 128 must be set with care. An effect of the transfer material trailing end regulating member 128 is gradually lowered as this member is raised.

In the fifth embodiment, an electrically insulating resin is used as a material of the transfer material trailing end regulating member 128. Needless to say, another insulating material, for example, rubber, porcelain or the like may be utilized as the electrically insulating material.

In the fifth embodiment in which the bias voltage is applied to the upper transfer guide 107 so that the toner splashing from the developing device 104 will not adhere to a tip of the upper transfer guide 107 in the vicinity of the photosensitive drum 101, the transfer material trailing end regulating member 128 has a role to prevent electrical leak from the charge eliminating brush 126.

In the fifth embodiment which is configured so that the straight line passing the conveying nip formed by the registration roller pair 105 and the vertex of the conveyance regulating member 122 intersects with the upper transfer guide 107 as described above, the transfer material is conveyed along the upper transfer guide 107 and strikes against the photosensitive drum 101 along a shape of the upper transfer guide 107.

Furthermore, the fifth embodiment allows a striking angle to be reduced by bending the upper transfer guide in the vicinity of the photosensitive drum, thereby being capable of moderating power of an impact produced by the striking transfer material and reducing an influence on an image.

Furthermore, the fifth embodiment allows a force to convey the transfer material along the upper transfer guide 107 to be strengthened by disposing the conveyance regulating member 122 on an upstream side of the conveying nip, thereby being capable of further reducing the striking angle.

On the other hand, the fifth embodiment is capable of stabilizing the conveyance of the trailing end of the transfer material immediately after the transfer material has passed through the conveying nip by disposing the transfer material trailing end regulating member 128, thereby preventing image blur at the trailing end.

Furthermore, the fifth embodiment is capable of preventing leak from the charge eliminating brush 126 by electrically insulating the transfer material trailing end regulating member 128.

(Sixth embodiment)

Figure 10:
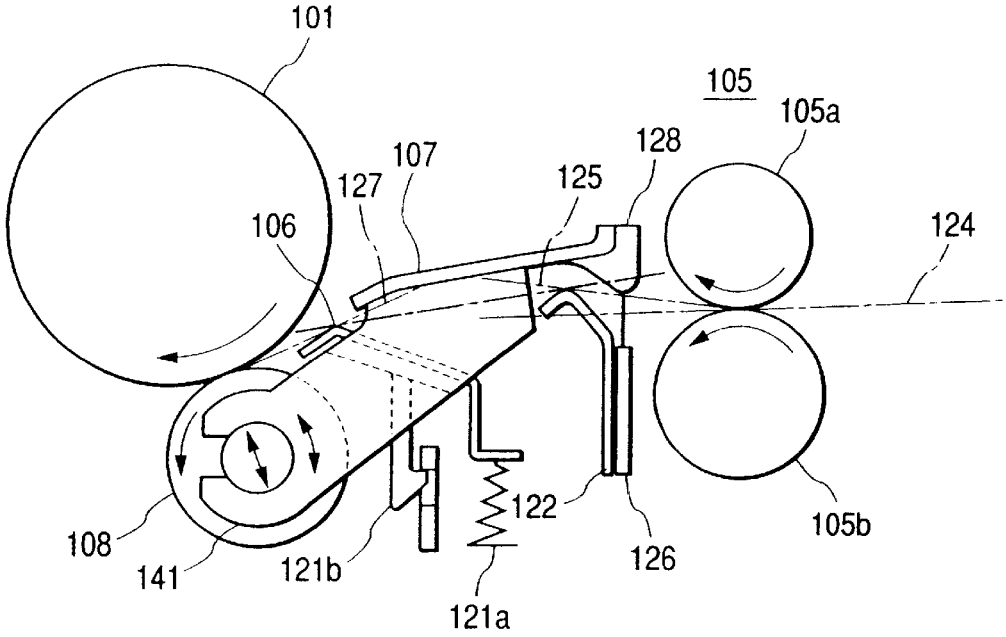
FIG. 10 is a schematic sectional view of the vicinities of a transfer position in a sixth embodiment of the image forming apparatus according to the present invention.

Now, a sixth embodiment of the image forming apparatus according to the present invention will be described with reference to FIG. 10. FIG. 10 is a schematic sectional view of a vicinity of a transfer position of the second embodiment of the image forming apparatus according to the present invention. Reference numerals which are the same as those described above denote the same members and will not be described in particular. Furthermore, an overall configuration and operations of the sixth embodiment are similar to those of the above described image forming apparatus shown in FIG. 9 and will not be described in particular.

In FIG. 10, reference numeral 141 denotes a guide support member which supports the lower transfer guide 106 as support means according to the present invention and the guide support member 141 is configured integrally with the upper transfer guide 107 in the sixth embodiment.

The guide support member 141 is urged upward via the lower transfer guide 106 by a spring 121*a* functioning as elastic means according to the present invention and regulated to a predetermined position by a positioning mechanism 121*b*.

The sixth embodiment which integrates the upper transfer guide 107 with the guide support member 141 is capable of not only providing an effect similar to that of the fifth embodiment of the image forming apparatus according to the present invention but also enhancing positional accuracy of the upper transfer guide 107 relative to the transfer position.

Accordingly, the sixth embodiment stabilizes a position at which the leading end of the transfer material strikes against the photosensitive drum 101, thereby being capable of stabilizing a degree of an influence on an image and providing favorable images stably.

Furthermore, the sixth embodiment is capable of simplifying a work to be done by a user for exchanging the transfer roller 108.

(Seventh embodiment)

Figure 11:
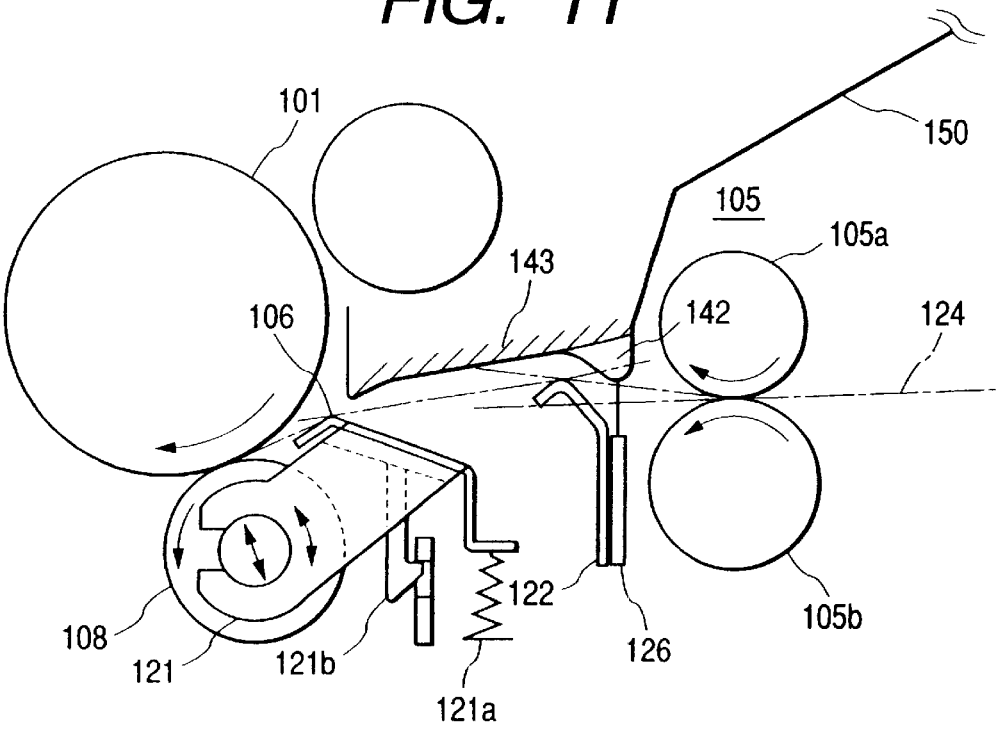
FIG. 11 is a schematic sectional view of the vicinities of a transfer position in a seventh embodiment of the image forming apparatus according to the present invention.

Now, a seventh embodiment of the image forming apparatus according to the present invention will be described with reference to FIG. 11. Shown in FIG. 11 is a schematic sectional view of the vicinity of a transfer position of the seventh embodiment of the image forming apparatus according to the present invention. Reference numerals which are the same as those described above denote the same members and will not be described in particular. Furthermore, an overall configuration and operations of the seventh embodiment are similar to those of the above described image forming apparatus shown in FIG. 9 and will not be described in particular.

In FIG. 11, reference numeral 150 denotes a process cartridge detachably mountable in a main body of an image forming apparatus. This process cartridge can be configured as an integral unit which optionally comprises the above described photosensitive drum 101, the developing device 104, the cleaner 112 or the like.

Reference numeral 143 denotes a bottom surface of developing means of the process cartridge 150 which is a wall surface of the process cartridge according to the present invention and has a rib shape configured so as to be the same as a conveying surface of the upper transfer guide 107 of the fifth embodiment.

Furthermore, a portion 142 is formed so as to have a form which is the same as the transfer material trailing end regulating member 128. Accordingly, the portion 142 serves as the sheet trailing end regulating member according to the present invention. Furthermore, this portion 142 may be made of an insulating material such as resin as described above.

The seventh embodiment is also capable of not only reducing an angle of the transfer material striking against the photosensitive drum 101 like the above described fifth embodiment and providing an effect similar to that of the fifth embodiment but also simplifying a configuration by imparting the function of the upper transfer guide to the process cartridge 150.

The image forming apparatus according to the present invention is configured so that the straight line passing the conveying nip formed by the pair of conveying members and the vertex of the conveyance regulating member intersects with the guide means as described above, whereby the sheet is conveyed along the guide means and strikes against the image bearing member along the shape of the guide means.

The image forming apparatus allows the angle at which the sheet strikes against the image bearing member to be further reduced by bending the guide means in the vicinity of the image bearing member, thereby moderating the power of the impact produced by the striking sheet and lowering the influence on an image.

Furthermore, the image forming apparatus allows the force to convey the transfer material along the upper transfer guide to be strengthened by disposing the conveyance regulating member above the conveying nip, thereby being capable of further reducing the angle of the sheet striking against the image bearing member.

On the other hand, the image forming apparatus is capable of stabilizing conveyance of the trailing end of the sheet immediately after the sheet has passed through the conveying nip by disposing the sheet trailing end regulating member, thereby preventing image blur at the trailing end of the sheet.

Furthermore, the image forming apparatus is capable of preventing leak from the charge eliminating brush by making the sheet trailing end regulating member of an insulating material.

Furthermore, the image forming apparatus uses the process cartridge detachably mountable in the main body of the image forming apparatus and utilizes the wall surface of the process cartridge as the guide means, whereby the image forming apparatus can have a simple configuration and be manufactured at a low cost.

What is claimed is:

1. A sheet conveying apparatus, comprising:

transferring means for transferring a developer having developed an electrostatic latent image on a photosensitive member to a sheet;

conveying means for nipping the sheet in a conveying nip formed by a rotary member pair to convey the sheet to said transferring means;

sheet guide means that comes into contact with a side of the sheet which is brought into contact with the photosensitive member for leading the sheet from said conveying means to said transferring means; and a conveyance regulating member which regulates a conveying direction of the sheet conveyed by said conveying means so that the sheet is brought into contact with said sheet guide means.

2. The sheet conveying apparatus according to claim 1, wherein said conveyance regulating member comprises a guide member for regulating the conveying direction of the sheet conveyed by said conveying means and for guiding the sheet.

3. The sheet conveying apparatus according to claim 1, wherein said conveyance regulating member comprises a guide member having elasticity and regulates the conveying direction of the sheet by urging the sheet which is in contact with said guide member.

4. The sheet conveying apparatus according to claim 3, wherein said guide member having elasticity comprises a conveyance guide portion which extends from a portion supported by a support member for supporting said guide member and which is brought into contact with the sheet, and wherein at least a portion of said conveyance guide portion has elasticity.

5. The sheet conveying apparatus according to claim 3, wherein said guide member having elasticity is swingably engaged with a support member for supporting said guide member and comprises a spring portion which is flexed when said guide member is brought into contact with the sheet.

6. The sheet conveying apparatus according to any one of claims 1 to 5, wherein said conveyance regulating member comprises a rotary member which is brought into contact with the sheet.

7. The sheet conveying apparatus according to any one of claims 1 to 5, wherein said conveyance regulating member has electrical conductivity.

8. The sheet conveying apparatus according to any one of claims 1 to 5, wherein said conveyance regulating member comprises an electrically conductive fibrous brush .

9. The sheet conveying apparatus according to any one of claims 1 to 5, wherein said sheet guide means comprises a first sheet guide member disposed on a side of said photosensitive member and a second sheet guide member disposed on a side opposite to said first sheet guide member, and wherein said conveyance regulating member is disposed between said conveying means and said first and second sheet guide members, and on a side of said second sheet guide member.

10. The sheet conveying apparatus according to any one of claims 1 to 5, wherein said sheet guide means is made of an electrically conductive material and comprises a sheet trailing end regulating member which regulates a trailing end of the sheet and which is made of an insulating material and which is disposed at an upstream end of said sheet guide means in a conveying direction of the sheet and on a side opposite to said conveyance regulating member.

11. The sheet conveying apparatus according to any one of claims 1 to 5, wherein said transferring means is a rotary member, and nips and conveys the sheet while being in contact with said photosensitive member.

12. An image forming apparatus, comprising:

a sheet conveying apparatus according to any one of claims 1 to 5; and image forming means which forms an image, by using a photosensitive member and transferring means, on a sheet conveyed by said sheet conveying apparatus.

13. The image forming apparatus according to claim 12, further comprising:

a process cartridge which comprises at least said photosensitive member and is detachably mountable in a main body of the image forming apparatus, wherein said process cartridge comprises sheet guide means.

14. An image forming apparatus comprising:

a pair of conveying members for nipping and conveying a sheet on which an image is to be formed;

an image bearing member for bearing the image to be formed on the sheet;

transferring means which is brought into contact with said image bearing member and transfers a toner image on said image bearing member to said sheet;

guide means for guiding the sheet conveyed by said pair of conveying members to a transfer nip between said image bearing member and said transferring means; and a conveyance regulating member which regulates a conveying direction of the sheet conveyed from a conveying nip of said pair of conveying members, wherein a straight line passing the conveying nip of said pair of conveying members and a contact point between the sheet and said conveyance regulating member intersects with said guide means.

15. The image forming apparatus according to claim 14, wherein said guide means comprises a sheet trailing end regulating member which comes into contact with the sheet having passed through said conveying nip and regulates a trailing end of the sheet.

16. The image forming apparatus according to claim 15, wherein said sheet trailing end regulating member is made of an electrically insulating material.

17. The image forming apparatus according to any one of claims 14 to 16, wherein said transferring means is a transfer roller, said image forming apparatus comprising support means which is swingably engaged with a rotary shaft of said transfer roller and which is urged in a predetermined direction by elastic means, and wherein said guide means is formed integrally with said support means.

18. The image forming apparatus according to any one of claims 14 to 16, wherein said guide means is configured by a wall surface of a process cartridge which is detachably mountable in a main body of said image forming apparatus.

19. An image forming apparatus, comprising:

conveying means for nipping and conveying a sheet;

an image bearing member for bearing an image to be formed on the sheet;

transferring means which nips the sheet in cooperation with said image bearing member and transfers a toner image on said image bearing member to the sheet;

a guide member which comes into contact with a surface of the sheet on which the image is to be formed and guides the sheet to said image bearing member; and a conveyance regulating member which guides the sheet so as to be brought into contact with said guide member, wherein said guide member guides the sheet so that the sheet is brought into contact with said image bearing member on an upstream side of a position in which the sheet is nipped by said transferring means.

20. The image forming apparatus according to claim 19, wherein said conveyance regulating member guides the sheet so that the sheet is pressed to said guide member due to a rigidity of the sheet.

21. The image forming apparatus according to claim 20, wherein said guide member guides the sheet in contact with the surface of the sheet on which the image is to be formed so that an angle formed by the sheet and a tangential line on a contact point of the image bearing member in which a leading end of the sheet comes into contact with said image bearing member is regulated to be smaller than a predetermined angle.

22. An image forming apparatus, comprising:

a photosensitive drum for bearing a toner image thereon;

a transfer roller for transferring the toner image on said photosensitive drum to a sheet;

a pair of rollers for nipping and conveying the sheet;

a guide that comes into contact with a side of the sheet which is brought into contact with said photosensitive drum for guiding the sheet conveyed by said pair of rollers to said photosensitive drum; and a leaf spring which regulates a conveying direction of the sheet conveyed by said pair of rollers so that the sheet is brought into contact with said guide.

* * * * *

UNITED STATES PATENT AND TRADEMARK OFFICE

CERTIFICATE OF CORRECTION

PATENT NO. : 6,493,534 B2 
DATED : December 10, 2002
INVENTOR(S) : Kei Sawanaka et al.

It is certified that error appears in the above-identified patent and that said Letters Patent is hereby corrected as shown below:

Column 2,
Line 45, “sent” should read -- is sent --.

Column 7,
Line 58, “there” should read -- these --.

Column 8,
Line 11, “not” should read -- will not be --.

Column 12,
Line 64, “redetermined” should read -- predetermined --.

Column 16,
Line 29, “trasnfer” should read -- transfer --.

Signed and Sealed this

Nineteenth Day of August, 2003

JAMES E. ROGAN
*Director of the United States Patent and Trademark Office*